US008869778B2

(12) United States Patent
Kim et al.

(10) Patent No.: US 8,869,778 B2
(45) Date of Patent: Oct. 28, 2014

(54) FUEL SUPPLY SYSTEM OF VEHICLE

(75) Inventors: Chang Han Kim, Gwangju (KR); Myeong Hwan Kim, Hwaseong-si (KR); Chang Jun Park, Hwaseong-si (KR)

(73) Assignee: Kia Motors Corp., Seoul (KR)

( * ) Notice: Subject to any disclaimer, the term of this patent is extended or adjusted under 35 U.S.C. 154(b) by 146 days.

(21) Appl. No.: 13/490,139

(22) Filed: Jun. 6, 2012

(65) Prior Publication Data

US 2013/0146025 A1 Jun. 13, 2013

(30) Foreign Application Priority Data

Dec. 8, 2011 (KR) ..... 10-2011-0130990

(51) Int. Cl.
*F02G 5/00* (2006.01)

(52) U.S. Cl.
USPC ..... 123/543; 123/179.7; 123/179.15; 123/179.16

(58) Field of Classification Search
CPC ... F02M 31/125; F02M 31/18; F02M 31/183; F02M 15/045; F02M 1/08; F02M 1/10; F02B 3/06
USPC ..... 123/543, 549, 552, 557, 179.7, 179.14, 123/179.15, 179.16
See application file for complete search history.

(56) References Cited

U.S. PATENT DOCUMENTS

| | | | | |
|---|---|---|---|---|
| 4,091,265 | A * | 5/1978 | Richards et al. | 219/501 |
| 4,383,507 | A * | 5/1983 | Powell | 123/179.21 |
| 4,413,594 | A * | 11/1983 | Hirota | 123/3 |
| 5,038,730 | A * | 8/1991 | Kashima | 123/179.21 |
| 5,465,701 | A * | 11/1995 | Hunt | 123/531 |
| 5,482,023 | A * | 1/1996 | Hunt et al. | 123/491 |
| 6,736,103 | B2 * | 5/2004 | Hunt et al. | 123/299 |
| 6,843,238 | B2 * | 1/2005 | Hunt et al. | 123/531 |
| 7,082,926 | B2 * | 8/2006 | Sadakane et al. | 123/431 |
| 7,237,539 | B2 * | 7/2007 | Mello et al. | 123/549 |
| 7,669,585 | B2 * | 3/2010 | Haag et al. | 123/456 |
| 7,798,131 | B2 * | 9/2010 | Hornby | 123/491 |
| 8,006,671 | B2 * | 8/2011 | Maeda et al. | 123/491 |
| 2008/0060621 | A1 * | 3/2008 | Trapasso et al. | 123/557 |
| 2009/0107473 | A1 * | 4/2009 | Imoehl et al. | 123/549 |
| 2009/0241915 | A1 * | 10/2009 | Sales | 123/549 |
| 2010/0078507 | A1 * | 4/2010 | Short | 239/584 |
| 2012/0012085 | A1 * | 1/2012 | Rowley et al. | 123/557 |

FOREIGN PATENT DOCUMENTS

| | | |
|---|---|---|
| JP | 05-195887 | 8/1993 |
| KR | 10-2009-0051655 A | 5/2009 |
| KR | 10-2010-0062722 A | 6/2010 |

* cited by examiner

*Primary Examiner* — Thomas Moulis

(74) *Attorney, Agent, or Firm* — Morgan, Lewis & Bockius LLP

(57) ABSTRACT

A fuel supply system of a vehicle, may include a fuel tank storing ethanol therein, a main injector installed at an engine to inject the ethanol from the fuel tank, a heater provided to heat the ethanol supplied from the fuel tank to the engine, a cold-starting injector installed at the engine to inject the ethanol heated by the heater, and a valve unit connected to the main injector and the cold-starting injector and performing a switching operation between a state of the ethanol being supplied from the fuel tank to the main injector and a state of the ethanol heated by the heater being supplied to the cold-starting injector.

8 Claims, 5 Drawing Sheets

FUEL SUPPLY SYSTEM OF VEHICLE

CROSS-REFERENCE TO RELATED APPLICATIONS

The present application claims priority to Korean Patent Application No. 10-2011-0130990 filed on Dec. 8, 2011, the entire contents of which is incorporated herein for all purposes by this reference.

BACKGROUND OF THE INVENTION

1. Field of the Invention

The present invention relates, in general, to a fuel supply system of a vehicle and, more particularly, to a fuel supply system of a vehicle which improves the capability to cold-start an engine of a flexible fuel vehicle (FFV) which primarily uses ethanol in a normal condition, whereas it uses gasoline in a special condition such as cold starting of the engine at a low temperature.

2. Description of Related Art

Generally, a common fuel supply system of a flexible fuel vehicle (FFV), which primarily uses ethanol that is significantly cheaper than gasoline, requires a sub-tank 500 for storing gasoline, as shown in FIG. 1. In the FFV, in order to secure smooth starting of an engine at a low external air temperature of generally below 18° C., it uses gasoline stored in the sub-tank 500 to start the engine.

That is, ethanol has a substantially decreased vapor pressure relative to gasoline under the same temperature condition, so that at a low temperature such as in wintertime, the ethanol is difficult to be vaporized, making it difficult to start the engine. Thus, the fuel supply system is operated such that in a normal condition at a relatively high temperature, it supplies ethanol from a main tank 502, in which only ethanol is stored, to a main injector 504 so as to start the engine, whereas at a low temperature, it controls a solenoid valve 508 to supply gasoline stored in the sub-tank 500 to a cold-starting injector 506 so as to start the engine.

However, the supply system having the sub-fuel (e.g. gasoline) supply section needs a number of parts such as the sub-tank 500, a pump, the solenoid valve 508, a vent line connected with a canister, and the like, causing the manufacturing cost of a vehicle to increase. Further, since the supply system is generally installed in an engine compartment, there is a risk of fire occurring due to carelessness when supplying a vehicle with gasoline. Further, since the sub-tank 500 installed in the relatively narrow engine compartment has a relatively small storage capacity, the gasoline should be frequently supplied, causing inconvenience. Moreover, as expensive gasoline is used, the user's cost problematically increases.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a fuel supply system of a vehicle which ensures smooth starting of an engine without using a separate gasoline supply, thereby reducing the manufacturing cost of a vehicle through elimination of a sub-tank for storing gasoline and a variety of other parts, preventing a possible risk of fire occurring in an engine compartment, reducing inconvenience of supplying a sub-fuel, and reducing a user's burden of paying fuel costs.

In an aspect of the present invention, a fuel supply system of a vehicle, may include a fuel tank storing ethanol therein, a main injector installed at an engine to inject the ethanol from the fuel tank, a heater provided to heat the ethanol supplied from the fuel tank to the engine, a cold-starting injector installed at the engine to inject the ethanol heated by the heater, and a valve unit connected to the main injector and the cold-starting injector and performing a switching operation between a state of the ethanol being supplied from the fuel tank to the main injector and a state of the ethanol heated by the heater being supplied to the cold-starting injector.

As previously set forth, according to the present invention, the fuel supply system of a vehicle is configured to ensure smooth starting of an engine without using a separate gasoline supply, thereby reducing the manufacturing cost of a vehicle through elimination of a sub-tank for storing gasoline and a variety of other parts, preventing a possible risk of fire occurring in an engine compartment, reducing inconvenience of feeding a sub-fuel, and reducing a user's burden of paying fuel costs.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

FIG. 4 is an exploded perspective view of the construction of FIG. 3 with respect to a fuel filter, a heater and the like.

Figure 1:
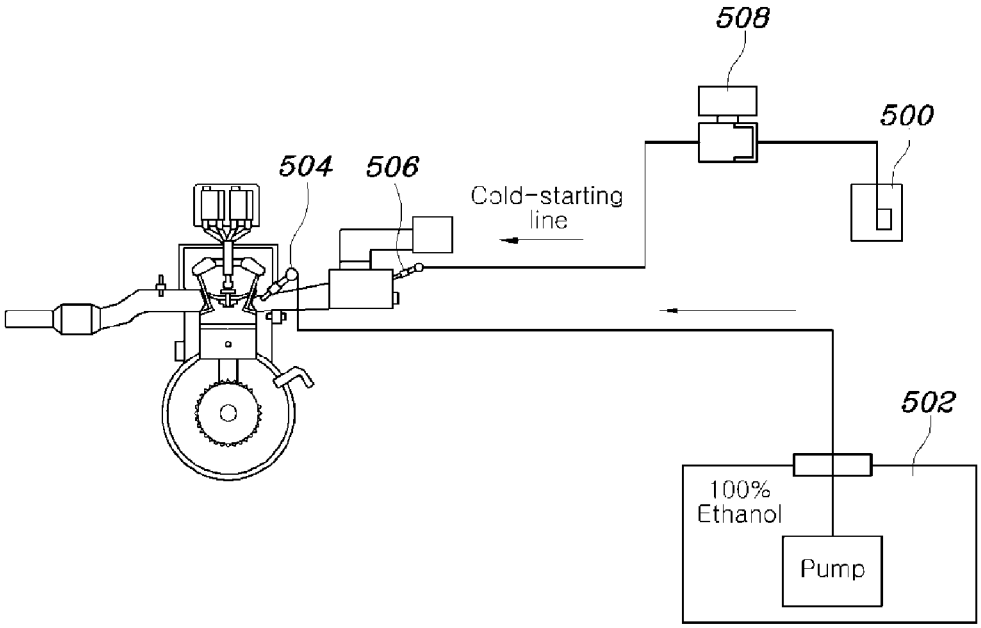
Fig. 1 (Related Art)
FIG. 1 is a view explaining a fuel supply system of a flexible fuel vehicle (FFV) according to the related art.
Figure 2:
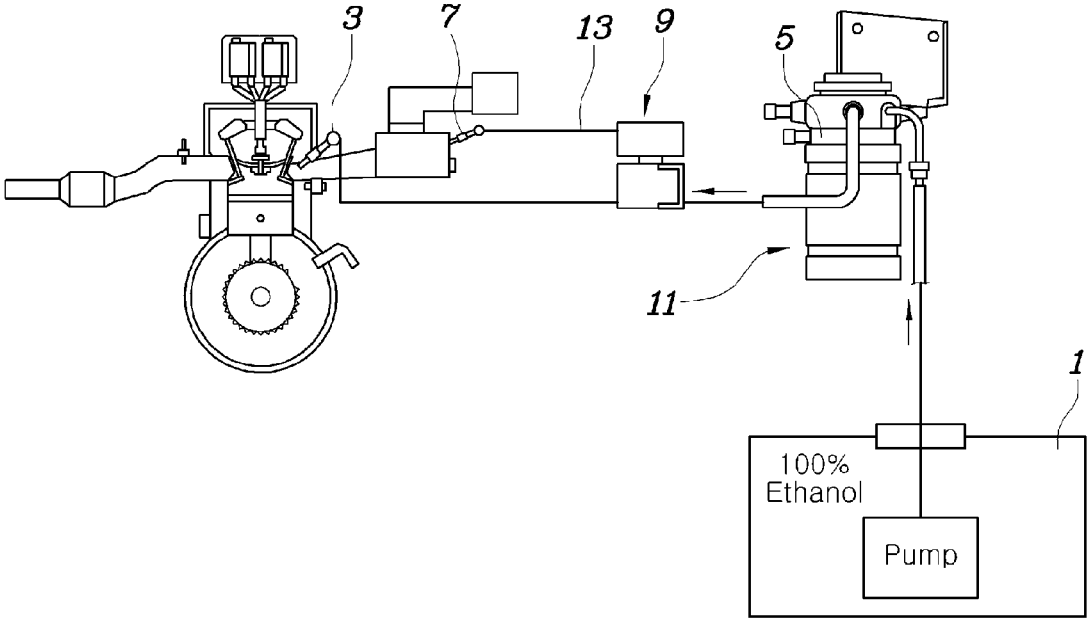
FIG. 2 is a view showing a fuel supply system of a vehicle according to an exemplary embodiment of the present invention.
Figure 3:
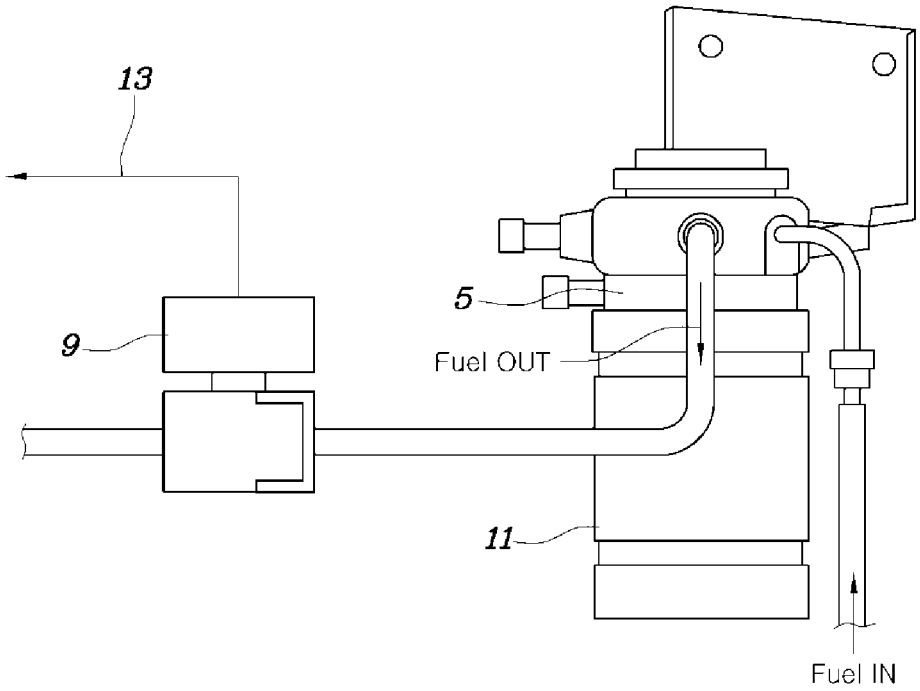
FIG. 3 is a detailed view showing the main construction of the fuel supply system of FIG. 2.
Figure 4:
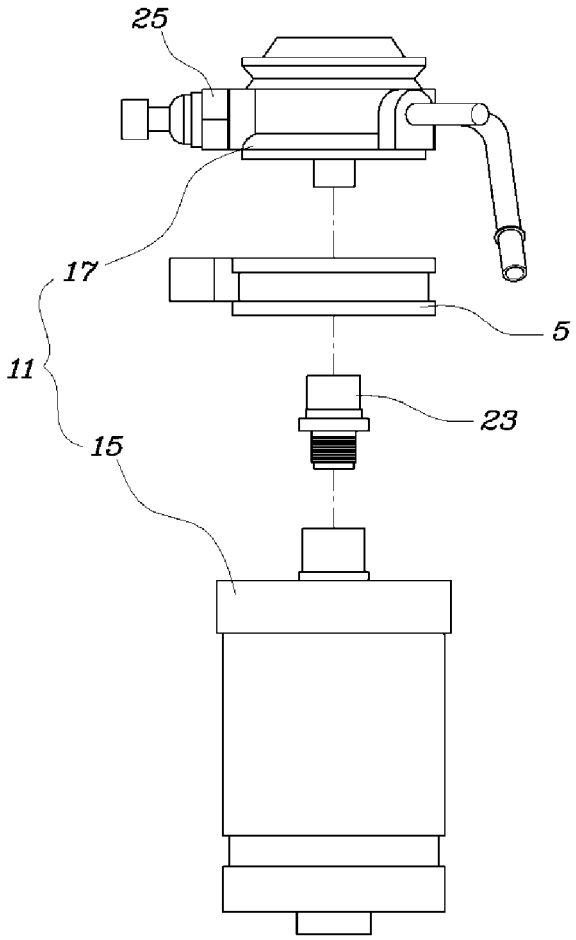
Figure 5:
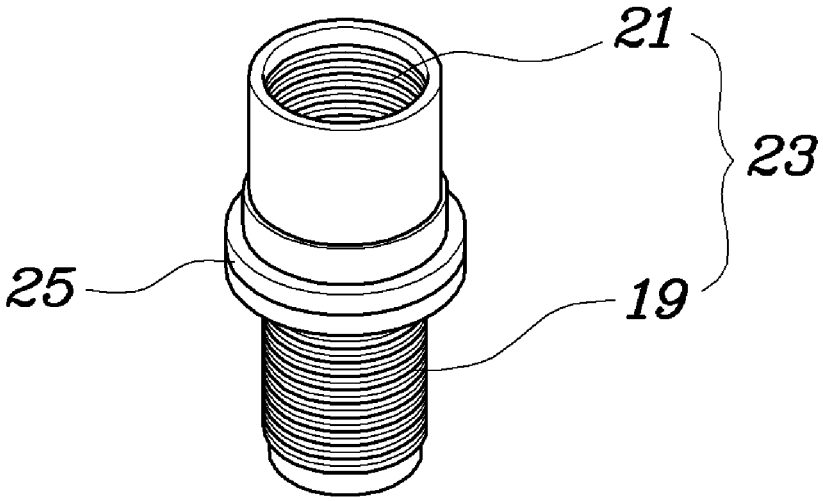
FIG. 5 is a perspective view showing a stud bolt shown in FIG. 4.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Reference will now be made in greater detail to a preferred embodiment of the invention, an example of which is illustrated in the accompanying drawings. Wherever possible, the same reference numerals will be used throughout the drawings and the description to refer to the same or like parts.

Referring to FIGS. 2 to 5, a fuel supply system of a vehicle according to an exemplary embodiment of the present invention includes: a fuel tank 1 which stores ethanol, a main injector 3 which is installed at an engine to inject the ethanol from the fuel tank 1, a heater 5 which is provided to heat the ethanol supplied from the fuel tank 1 to the engine, a cold-starting injector 7 which is installed at the engine to inject the ethanol heated by the heater 5, and a valve unit 9 which performs a switching operation between the state of the ethanol being supplied from the fuel tank 1 to the main injector 3 and the state of the ethanol heated by the heater 5 being supplied to the cold-starting injector 7.

The fuel supply system heats the ethanol, which is supplied from the fuel tank 1 to the engine, with the heater 5 so as to forcedly increase vapor pressure of the ethanol, so that even when an engine is cold started at a low temperature, the engine can be started with only ethanol. This eliminates a variety of parts that were conventionally required to separately supply gasoline, thereby removing inconvenience or risk and a user's burden owing to additional supply of gasoline in addition to ethanol.

The cold-starting injector 7 is preferably arranged upstream of an intake system relative to the main injector 3.

Although ethanol injected from the cold-starting injector 7 is heated by the heater 5 and thus is smoothly vaporized, since sufficient mixing with air rather than when being introduced into a combustion compartment and thus creating a fuel-air mixture is advantageous in engine-starting, it is preferred that the cold-starting injector be installed around a surge tank or the like which is upstream of the main injector 3 which is generally installed on an intake port.

The heater 5 is installed to a filter 11 which filters ethanol supplied from the fuel tank 1.

While the heater 5 may be installed at another place, the heater 5 is advantageously installed to the filter 11 which is provided to filter ethanol supplied from the fuel tank 1 to the engine. This is because, if the filter 11 equipped with the heater 5 is installed in an engine compartment, the filter 11 and the heater 5 can be easily repaired and maintained, and a cold-starting line 13 from the heater 5 to the cold-starting injector 7 can be provided to be as short as possible, thereby minimizing cooling of the ethanol that is heated by the heater 5.

More specifically, the filter 11 includes a body 15 containing filtering elements therein, and a head 17 having an inlet through which the ethanol is supplied from the fuel tank 1 and an outlet out of which the filtered ethanol is discharged. Here, the heater 5 is integrally formed between the body 15 and the head 17.

In the exemplary embodiment, in order to install the heater 5 to the filter 11, a stud bolt 23 is interposed between the body 15 and the head 17, wherein the stud bolt is integrally formed at opposite ends thereof with an external screw 19 for the head 17 and an internal screw 21 for the body 15.

The stud bolt 23 may include a mounting bracket 25 formed between the external screw 19 and the internal screw 21 such that the heater 5 is installed between the body 15 and the head 17 while being inserted around the mounting bracket 25 of the stud bolt 23.

Thus, the heater 5 can be easily installed to the filter 11 with the configuration in which only the stud bolt 23 is added while utilizing the conventional filter 11 only including the head 17 and the body 15 as it is.

A thermo-switch 25 is also preferably provided in the head 17 of the filter in order to determine whether to operate the heater 5 according to the temperature of ethanol.

That is, if the temperature of the ethanol is below a predetermined threshold temperature at which an engine cannot be cold-started, when the engine is started, the thermo-switch 25 automatically operates the heater 5 to heat the ethanol and supplies the heated ethanol to the cold-starting injector 7.

If the valve unit 9 is configured with a solenoid valve that is operated in response to electricity applied by ECU, the thermo-switch 25 and the heater 5 are configured to operate in association with the solenoid valve, allowing the operation of supplying ethanol to switch such that the ethanol heated by the heater 5 is supplied to the cold-staring injector 7 rather than the main injector 3.

Figure 7:
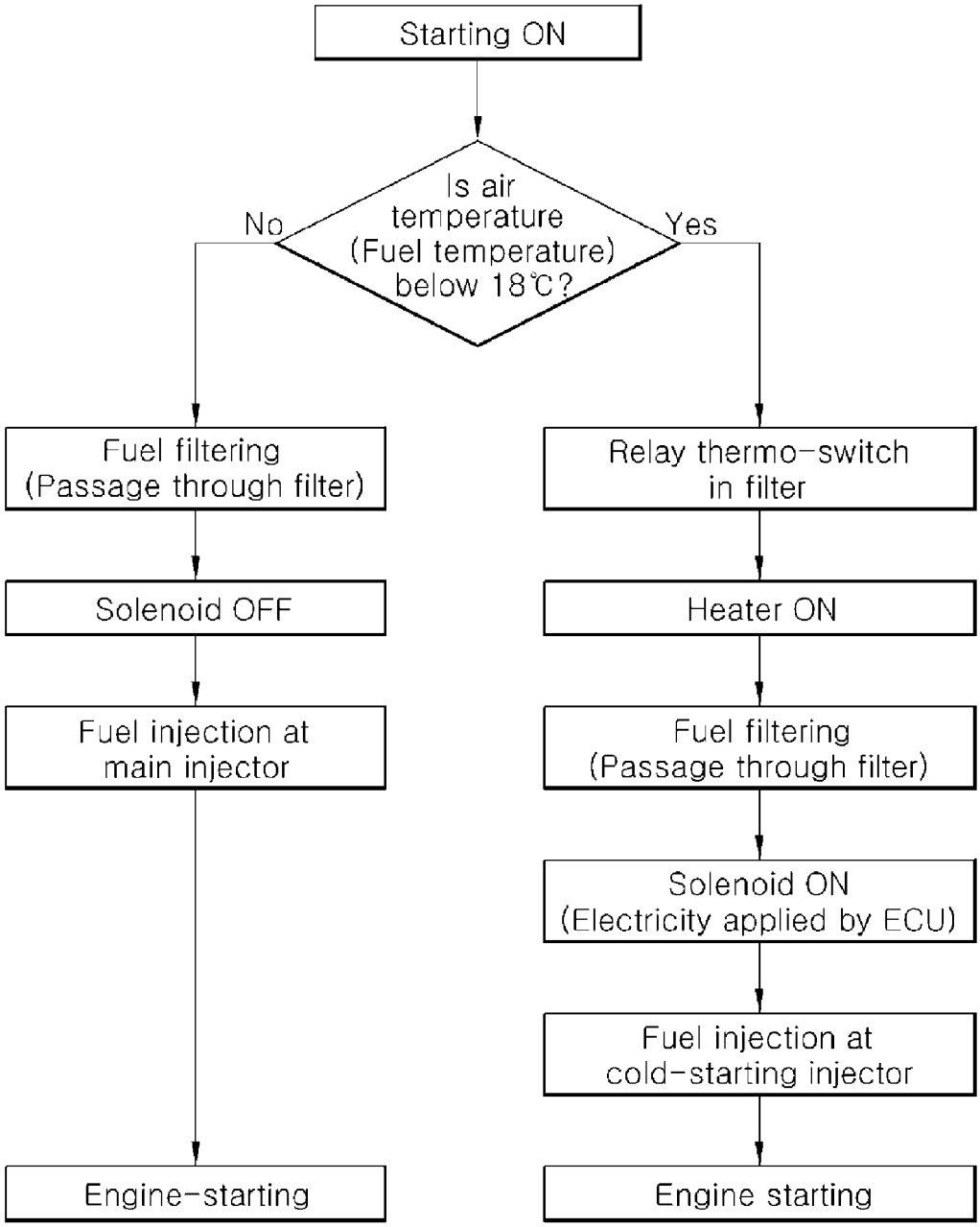
FIG. 7 is a flow chart showing the operation of the fuel supply system of a vehicle according to an exemplary embodiment of the present invention.

If the temperature of the ethanol is, for example, below 18° C. when an engine is started, as shown in FIG. 7, the thermo-switch 25 detects this condition and operates the heater 5 and concurrently controls the solenoid valve of the valve unit 9 to switch to the state of the ethanol heated by the heater 5 being supplied to the cold-starting injector 7. Thereby, the ethanol heated by the heater 5 is injected with sufficiently high vapor pressure, thereby being smoothly vaporized, so that an ethanol-air mixture that is suitable for starting an engine is supplied to the combustion compartment, which ensures smooth starting of the engine.

Figure 6:
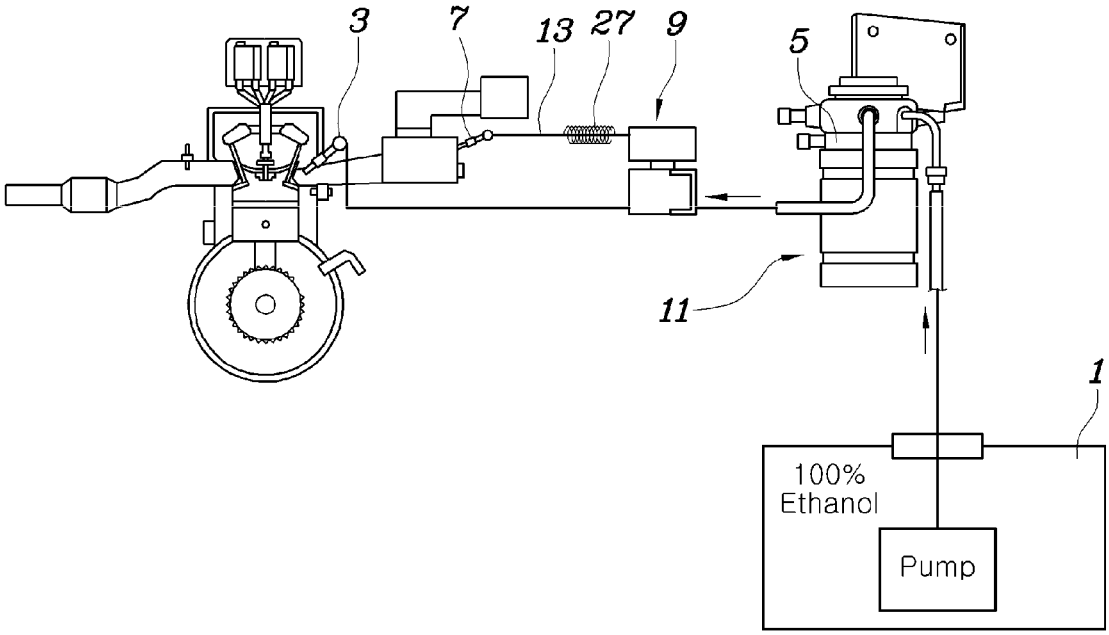
FIG. 6 is a view showing a fuel supply system of a vehicle according to another embodiment of the present invention.

Meanwhile, referring to FIG. 6, a fuel supply system of a vehicle according to a second embodiment is illustrated, wherein a second heater 27 for heating ethanol flowing therethrough is further provided to the cold-starting line 13 that is a passage through which the ethanol heated by the heater 5 is supplied to the cold-starting injector 7 according to the first embodiment.

That is, the ethanol, which is supplied to the cold-starting injector 7 while being heated by the heater 5, is further heated at the cold-starting line 13, which is a supply passage of the ethanol, by the second heater 27, further increasing the temperature of the ethanol, thereby ensuring more secure starting performance of an engine.

The second heater 27 may be composed of a hot coil or the like that is wound around the circumference of the cold-starting line 13.

Although a preferred embodiment of the present invention has been described for illustrative purposes, those skilled in the art will appreciate that various modifications, additions and substitutions are possible, without departing from the scope and spirit of the invention as disclosed in the accompanying claims.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A fuel supply system of a vehicle, comprising:

a fuel tank storing ethanol therein;

a main injector installed at an engine and connected to the fuel tank to inject the ethanol from the fuel tank;

a first heater provided to heat the ethanol supplied from the fuel tank to the engine;

a cold-starting injector installed at the engine to inject the ethanol heated by the first heater; and a valve unit, an output of which is connected to the main injector and the cold-starting injector and performing a switching operation between a state of the ethanol being supplied from the fuel tank to the main injector and a state of the ethanol heated by the first heater being supplied to the cold-starting injector;

wherein a second heater for heating ethanol flowing therethrough is further provided to a cold-starting line that is a passage through which the ethanol heated by the first heater is supplied to the cold-starting injector.

2. The fuel supply system according to claim 1, wherein the first heater is installed to a filter connected between the valve unit and the fuel tank for filtering the ethanol supplied from the fuel tank.

3. The fuel supply system according to claim 1, wherein the cold-starting injector is arranged upstream of an intake system relative to the main injector.

4. The fuel supply system according to claim 2, wherein the filter includes:

a body containing filtering elements therein; and a head fluid-connected to the body and having an inlet through which the ethanol is supplied from the fuel tank and an outlet out of which the filtered ethanol is discharged to the valve unit, wherein the first heater is integrally mounted between the body and the head.

5. The fuel supply system according to claim 4, wherein a thermo-switch is provided in the head of the filter to determine whether to operate the first heater according to a temperature of the ethanol.

6. The fuel supply system according to claim 4, wherein a stud bolt is interposed between the body and the head, wherein the stud bolt is integrally formed at opposite ends thereof with an external screw for the head and an internal screw for the body, and wherein the first heater is installed between the body and the head while being inserted around the stud bolt.

7. The fuel supply system according to claim 4, wherein a stud bolt is interposed between the body and the head to connect the head and the body, and wherein the study bolt includes an internal screw formed at one end portion thereof to which the head or the body is engaged, an external screw formed at another end portion thereof to which the head or the body is engaged, and a mounting bracket formed between the internal screw and the external screw and onto which the first heater is mounted.

8. The fuel supply system according to claim 2, wherein the filter and the first heater are provided in an engine compartment.

* * * * *